US009276359B2

(12) United States Patent
Brown

(10) Patent No.: US 9,276,359 B2
(45) Date of Patent: Mar. 1, 2016

(54) CORD COUPLING SECUREMENT DEVICE

(71) Applicant: Blair Brown, Brampton (CA)

(72) Inventor: Blair Brown, Brampton (CA)

( * ) Notice: Subject to any disclaimer, the term of this patent is extended or adjusted under 35 U.S.C. 154(b) by 0 days.

(21) Appl. No.: 14/308,892

(22) Filed: Jun. 19, 2014

(65) Prior Publication Data

US 2015/0372422 A1 Dec. 24, 2015

(51) Int. Cl.
*H01R 13/62* (2006.01)
*H01R 13/639* (2006.01)

(52) U.S. Cl.
CPC ..... *H01R 13/6392* (2013.01)

(58) Field of Classification Search
CPC ..... H01R 13/6392
USPC ..... 439/369, 367, 368, 371
See application file for complete search history.

(56) References Cited

U.S. PATENT DOCUMENTS 4,183,603 A 1/1980 Donarummo
4,206,961 A 6/1980 Cifalde
4,664,463 A 5/1987 Carmo
4,907,984 A 3/1990 Keller
4,917,626 A 4/1990 Barton
4,957,450 A 9/1990 Pioszak
5,167,524 A * 12/1992 Falcon et al. ..... 439/371
D340,695 S 10/1993 Merriman et al.
5,306,176 A 4/1994 Coffey
7,407,405 B1 * 8/2008 Slenczka ..... 439/369

FOREIGN PATENT DOCUMENTS

WO WO9528023 A1 10/1995

* cited by examiner

*Primary Examiner* — Phuongchi T Nguyen

(57) ABSTRACT

A cord coupling securement device secures a male plug to a female plug to prevent unintended disconnection of coupled extension cords. The device includes a first cable tie configured for coupling to a first cord adjacent to a first cord plug and a second cable tie configured for coupling to a second cord adjacent to a second cord plug engageable to the first cord plug. A strap extends transversely from a loop formed by coupling the first cable tie to the first cord. The strap is insertable through a receiver such that the strap is coupled to the receiver and the first cable tie is secured to the second cable tie.

9 Claims, 3 Drawing Sheets

CORD COUPLING SECUREMENT DEVICE

BACKGROUND OF THE DISCLOSURE

Field of the Disclosure

The disclosure relates to securement devices and more particularly pertains to a new securement device for securing a male plug to a female plug to prevent unintended disconnection of coupled extension cords.

SUMMARY OF THE DISCLOSURE

An embodiment of the disclosure meets the needs presented above by generally comprising a first cable tie configured for coupling to a first cord adjacent to a first cord plug and a second cable tie configured for coupling to a second cord adjacent to a second cord plug engageable to the first cord plug. A strap extends transversely from a loop formed by coupling the first cable tie to the first cord. The strap is insertable through a receiver such that the strap is coupled to the receiver and the first cable tie is secured to the second cable tie.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
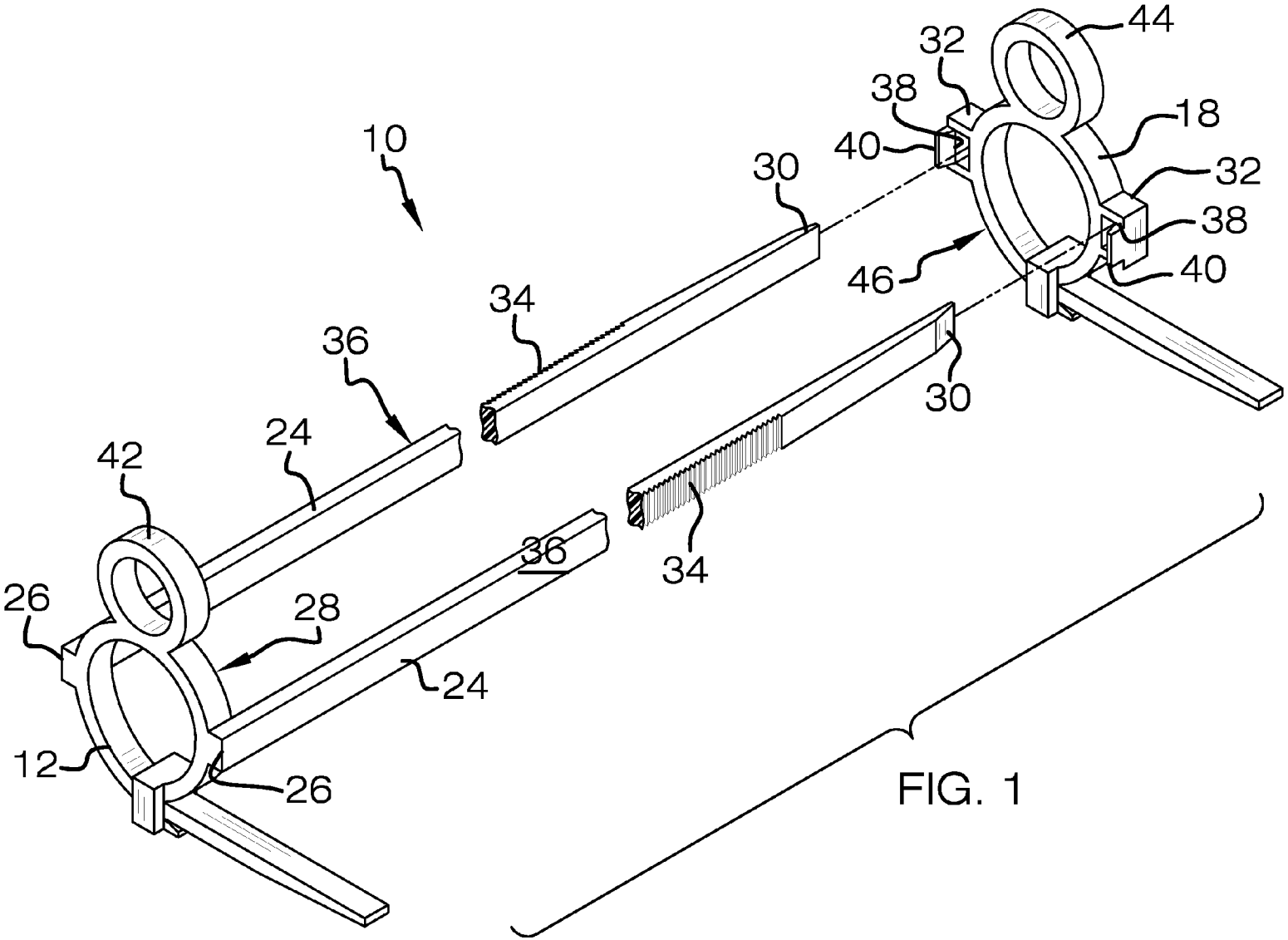
FIG. 1 is an exploded top front side perspective view of a cord coupling securement device according to an embodiment of the disclosure.
Figure 2:
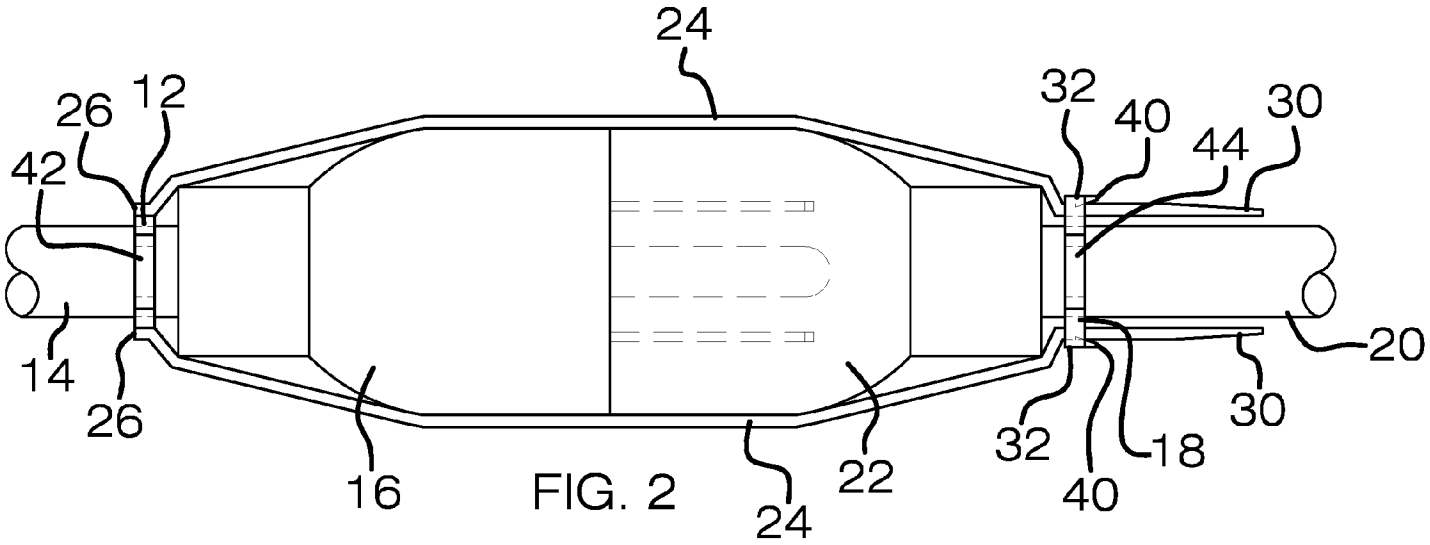
FIG. 2 is a top view of an embodiment of the disclosure in use.
Figure 3:
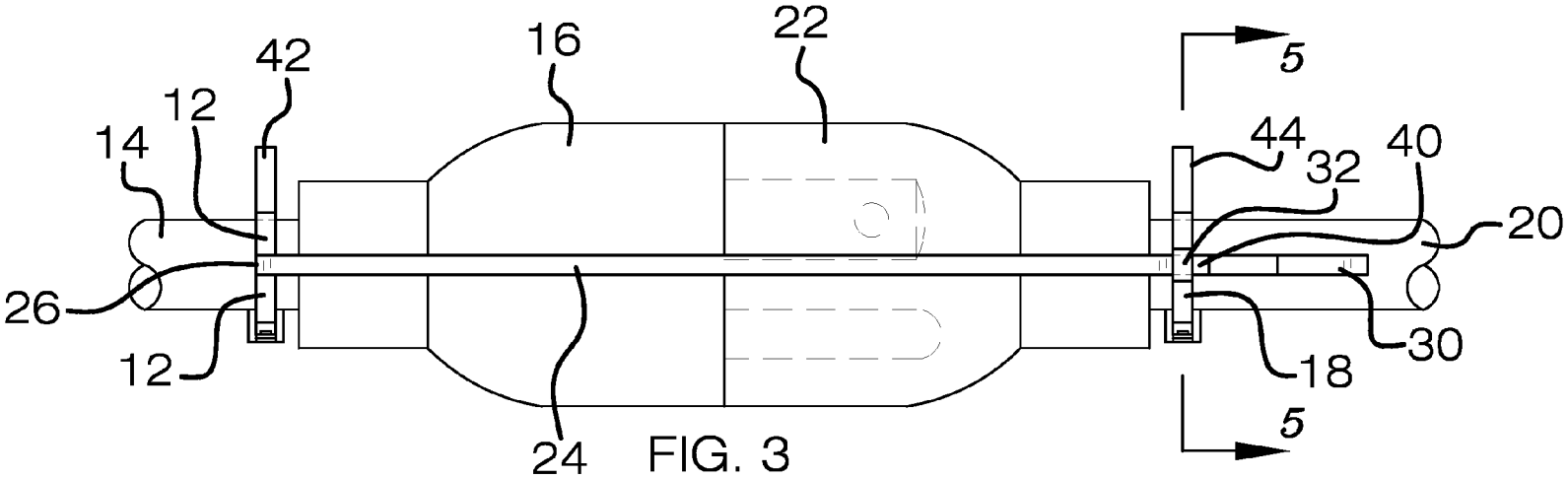
FIG. 3 is a side view of an embodiment of the disclosure in use.
Figure 4:
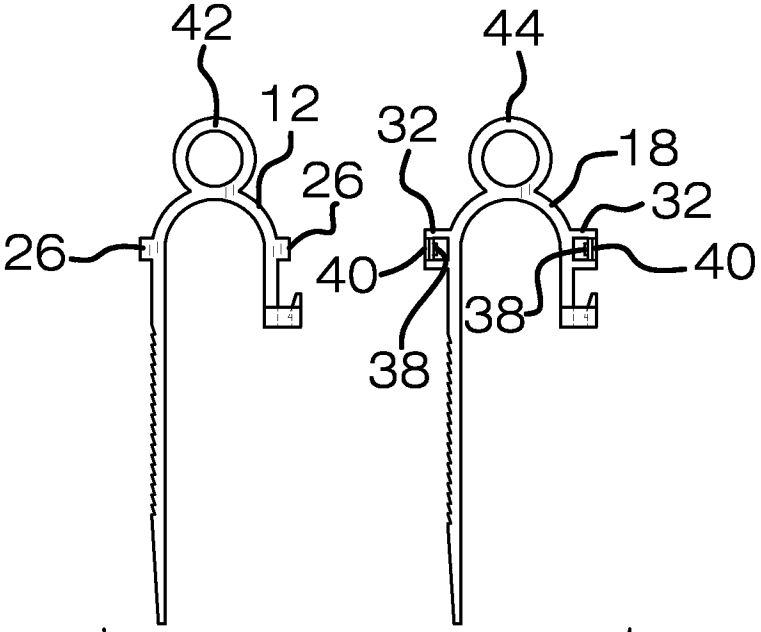
FIG. 4 is an end view of an embodiment of the disclosure.
Figure 5:
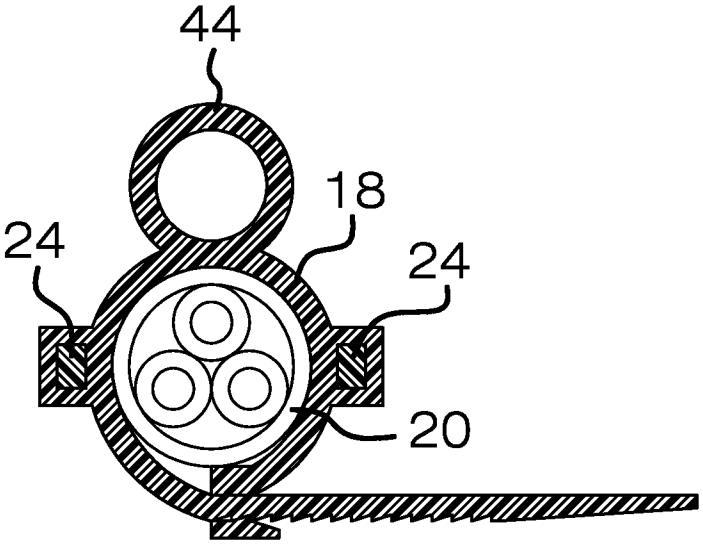
FIG. 5 is a cross-sectional view of an embodiment of the disclosure taken along line 5-5 of FIG. 3.

With reference now to the drawings, and in particular to FIGS. 1 through 5 thereof, a new securement device embodying the principles and concepts of an embodiment of the disclosure and generally designated by the reference numeral 10 will be described.

As best illustrated in FIGS. 1 through 5, the cord coupling securement device 10 generally comprises a first cable tie 12 configured for coupling to a first cord 14 adjacent to a first cord plug 16. A second cable tie 18 is configured for coupling to a second cord 20 adjacent to a second cord plug 22 engageable to the first cord plug 16. Each of a plurality of straps 24 has a base end 26 coupled to the first cable tie 12 such that each strap 24 extends transversely from a loop 28 formed by coupling the first cable tie 12 to the first cord 14. Each strap 24 has a tapered end section 30. Each of a plurality of receivers 32 is coupled to the second cable tie 18. A respective associated strap 24 is insertable through each receiver 32 such that the associated strap 24 is coupled to the receiver 32 wherein the first cable tie 12 is secured to the second cable tie 18 and the first cord plug 16 is prevented from disengaging from the second cord plug 22. The number of straps 24 may be two which are positioned spaced on the first cable tie 12 such that the straps 24 are substantially diametrically opposed when the loop 28 is formed. Each receiver 32 is similarly spaced along the second cable tie 18.

A respective plurality of teeth 34 extends along a respective face 36 of each strap 24. Each face 36 is oriented to face outwardly relative to the loop 28 formed by the first cable tie 12. A respective pawl 38 is coupled to each receiver 32. The pawl 38 of each receiver 32 engages the teeth 34 of the associated strap 24 wherein the associated strap 24 is retained in the receiver 32 when the associated strap 24 is inserted through the receiver 32. Each pawl 38 comprises a tab 40 extending from the receiver 32 to which the pawl 38 is coupled. The tab 40 is pivotable relative to the receiver 32 to which the pawl 38 is coupled wherein the pawl 38 is disengageable from the teeth 34 of the associated strap 24. Thus, the associated strap 24 is removable from the receiver 32 when the pawl 38 is disengaged allowing the device 10 to be used multiple times. The same pawl, receiver and tab structure may be incorporated into the first cable tie 12 and second cable tie 18 to permit removal of each from the first cord 14 and the second cord 20 respectively.

A first ring 42 is coupled to the first cable tie 12. The first ring 42 is coplanar with the loop 28 formed by the first cable tie 12 when the first cable tie 12 is coupled to the first cord 14. A second ring 44 is coupled to the second cable tie 18. The second ring 44 is coplanar with a loop 46 formed by the second cable tie 18 when the second cable tie 18 is coupled to the second cord 20. The first loop 42 and second loop 44 may be used to secure multiple cords to a multi-plug type of cord.

In use, the first cable tie 12 is coupled to the first cord 14 and the second cable tie 18 is coupled to the second cord 20. The first cord plug 16 is coupled to the second cord plug 22. The straps 24 are inserted through the associated receivers 32 and pulled substantially snug to prevent separation of the first cord plug 16 from the second cord plug 22.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A cord coupling securement device comprising:

a first cable tie configured for coupling to a first cord adjacent to a first cord plug;

a second cable tie configured for coupling to a second cord adjacent to a second cord plug engageable to the first cord plug;

a strap having a base end coupled to said first cable tie wherein said strap extends transversely from a loop formed by coupling said first cable tie to the first cord; and a receiver coupled to said second cable tie, said strap being insertable through said receiver such that said strap is coupled to said receiver wherein said first cable tie is secured to said second cable tie; and a first ring coupled to said first cable tie.

2. The device of claim 1, further comprising said strap being one of a plurality of said straps and said receiver being one of a plurality of said receivers, each said strap being insertable through an associated one of said receivers.

3. The device of claim 1, further comprising:

a plurality of teeth extending along a face of said strap; and a pawl coupled to said receiver, said pawl engaging said teeth wherein said strap is retained in said receiver when said strap is inserted through said receiver.

4. The device of claim 1, further comprising said strap having a tapered end section.

5. The device of claim 3, further comprising said pawl comprising a tab extending from said receiver, said tab being pivotable relative to said receiver wherein said pawl is disengageable from said teeth such that said strap is removable from said receiver when said pawl is disengaged.

6. The device of claim 1, further comprising said first ring being coplanar with a loop formed by said first cable tie when said first cable tie is coupled to the first cord.

7. The device of claim 1, further comprising a second ring coupled to said second cable tie.

8. The device of claim 7, further comprising said second ring being coplanar with a loop formed by said second cable tie when said second cable tie is coupled to the second cord.

9. A cord coupling securement device comprising:

a first cable tie configured for coupling to a first cord adjacent to a first cord plug;

a second cable tie configured for coupling to a second cord adjacent to a second cord plug engageable to the first cord plug;

a plurality of straps, each said strap having a base end coupled to said first cable tie wherein each said strap extends transversely from a loop formed by coupling said first cable tie to the first cord, each said strap having a tapered end section;

a plurality of receivers, each said receiver being coupled to said second cable tie, a respective associated strap being insertable through each said receiver such that said associated strap is coupled to said receiver wherein said first cable tie is secured to said second cable tie;

a respective plurality of teeth extending along a face of each said strap;

a respective pawl coupled to each said receiver, said pawl engaging said teeth of said associated strap wherein said associated strap is retained in said receiver when said associated strap is inserted through said receiver, each said pawl comprising a tab extending from said receiver to which said pawl is coupled, said tab being pivotable relative to said receiver to which said pawl is coupled wherein said pawl is disengageable from said teeth of said associated strap such that said associated strap is removable from said receiver when said pawl is disengaged;

a first ring coupled to said first cable tie, said first ring being coplanar with a loop formed by said first cable tie when said first cable tie is coupled to the first cord; and a second ring coupled to said second cable tie, said second ring being coplanar with a loop formed by said second cable tie when said second cable tie is coupled to the second cord.

* * * * *